US010196575B2

(12) United States Patent
Zhan et al.

(10) Patent No.: US 10,196,575 B2
(45) Date of Patent: Feb. 5, 2019

(54) LUBRICATING BASE OIL PRODUCTION

(71) Applicants: Bi-Zeng Zhan, Albany, CA (US); Horacio Trevino, Richmond, CA (US); Theodorus Ludovicus Michael Maesen, Moraga, CA (US); Guan-Dao Lei, Richmond, CA (US)

(72) Inventors: Bi-Zeng Zhan, Albany, CA (US); Horacio Trevino, Richmond, CA (US); Theodorus Ludovicus Michael Maesen, Moraga, CA (US); Guan-Dao Lei, Richmond, CA (US)

(73) Assignee: Chevron U.S.A. Inc., San Ramon ( * ) Notice: Subject to any disclaimer, the term of this patent is extended or adjusted under 35 U.S.C. 154(b) by 469 days.

(21) Appl. No.: 14/541,684

(22) Filed: Nov. 14, 2014

(65) Prior Publication Data

US 2015/0136646 A1 May 21, 2015

Related U.S. Application Data

(60) Provisional application No. 61/904,730, filed on Nov. 15, 2013.

(51) Int. Cl.

| | |
|---|---|
| ***C10G 47/06*** | (2006.01) |
| ***C10G 65/12*** | (2006.01) |
| ***C10G 67/02*** | (2006.01) |
| ***C10M 101/02*** | (2006.01) |

(52) U.S. Cl.

CPC ..... *C10M 101/02* (2013.01); *C10G 47/06* (2013.01); *C10G 65/12* (2013.01); *C10G 67/02* (2013.01)

(58) Field of Classification Search

CPC ..... C10M 101/02; C10G 67/02; C10G 65/12; C10G 47/06

See application file for complete search history.

(56) References Cited

U.S. PATENT DOCUMENTS

| | | | | |
|---|---|---|---|---|
| 4,851,109 | A | 7/1989 | Chen et al. | |
| 7,513,989 | B1 | 4/2009 | Soled et al. | |
| 2005/0051463 | A1 | 3/2005 | Miller et al. | |
| 2009/0107883 | A1 | 4/2009 | Maesen et al. | |
| 2011/0163009 | A1* | 7/2011 | Novak | B01J 23/002 208/210 |
| 2013/0105359 | A1* | 5/2013 | Noh | B01J 29/12 208/57 |

FOREIGN PATENT DOCUMENTS

| | | |
|---|---|---|
| CN | 102906231 | 11/2015 |
| WO | 2011071803 | 6/2011 |

OTHER PUBLICATIONS

Tenary Phase Diagram.*

PCT/US2014/065712, Notification of Transmittal of the International Search Report and the Written Opinion of the International Searching Authority , or the Declaration, dated Feb. 3, 2015, 13 pages.

* cited by examiner

*Primary Examiner* — Randy Boyer
*Assistant Examiner* — Juan C Valencia
(74) *Attorney, Agent, or Firm* — Mark L. Warzel

(57) ABSTRACT

A process is provided for producing a heavy lubricating base oil by hydrocracking a lubricating oil feedstock at high yield. The lubricating oil feedstock contains a hydroprocessed stream that is difficult to process using a conventional catalyst system. The catalyst used in the process includes a mixed metal sulfide catalyst that comprises at least one Group VIB metal and at least one Group VIII metal. The process also provides for hydroisomerization and hydrofinishing process steps to prepare the lubricating base oil.

20 Claims, No Drawings

LUBRICATING BASE OIL PRODUCTION

CROSS-REFERENCE TO RELATED APPLICATIONS

The present application for patent claims the benefit of U.S. provisional patent application bearing Ser. No. 61/904,730, filed on Nov. 15, 2013, which is incorporated by reference in its entirety.

TECHNICAL FIELD

The invention relates generally to a process for making a heavy lubricating base oil using a self-supported mixed metal sulfide catalyst.

BACKGROUND

Modern lubricating oils prepared from petroleum sources require multiple processing steps from the crude oil from which they are derived. Each of the processing steps is carefully controlled to achieve the required properties to meet modern lubricant needs and specifications. Lubricating base oils are the product from these processing steps. The base oils, in turn, provide the base ingredients that, when combined with generally smaller quantities of other materials, often termed "additives", produce the lubricants that are the end use products for the process.

One challenge for the refiner in preparing base oils is to maintain a high selectivity of the desired product during each process step. Many of the process steps in producing lubricating base oil involves a chemical reaction, often in the presence of at least one catalyst. The more selective each catalyst is for the reactions that occur in a particular process step, the higher the amount of feed is converted into the desired product in the process step. Other products that are formed during the process step are generally of lower value than the desired product. Improving one or more process steps often includes changes to the catalyst, feed or process conditions that results in higher selectivity to the desired product, and thus ultimately a higher yield of lubricating base oil.

A lubricating base oil process using a petroleum based feedstock generally produces a range of lubricating base oils, differentiated at least by boiling range and by viscosity. Lower viscosity base oil products tend to dominate the product slate from a particular process. In contrast, higher viscosity base oils are often more difficult to make. Heteroatoms such as sulfur and nitrogen tend to be concentrated in heavier petroleum fractions, and the processes to remove them tend to reduce the yield of high viscosity products. Heavier petroleum fractions also tend to concentrate aromatics and other low viscosity index molecules; upgrading these fractions to achieve a high viscosity index has the same negative impact on yield of the high viscosity products.

A number of methods have been proposed for producing high quality base oils having a high viscosity. For example, U.S. Pat. No. 7,776,206 describes a distillation method for producing a lubricant bright stock. The goal remains of developing new catalytic processes for producing a high viscosity lubricating base oil at high yields.

SUMMARY OF THE INVENTION

The process of this invention produces a lubricating base oil from a lubricating oil feedstock that is difficult to process using conventional methods. In the process, a lubricating oil feedstock comprising a hydroprocessed feedstream is provided to a hydrocracking reaction zone; and the lubricating oil feedstock is hydrocracked with a hydrogen-containing treat gas stream under hydrocracking conditions to form a hydrocrackate. The lubricating oil feedstock has a nitrogen content of greater than 300 ppm and a sulfur content of greater than 0.1 wt. %. In the hydrocracking reaction zone, at least 10 wt. % of the feedstock is converted to products which boil below the initial boiling point of the feedstock. The hydrocrackate is separated into at least a gaseous product that contains ammonia, and a liquid fraction that boils above the initial boiling point of the feedstock; and has a nitrogen content of less than 50 ppm. In one embodiment, the liquid fraction is dewaxed in the presence of a hydrogen-containing treat gas stream over a shape selective intermediate pore size molecular sieve catalyst at hydroisomerization conditions, to produce a dewaxed effluent having a pour point of less than −5° C. The dewaxed effluent is provided to a hydrofinishing reaction zone for hydrogenating the dewaxed effluent over a hydrofinishing catalyst, to form a heavy lubricating base oil having a viscosity index of greater than 95 and a viscosity at 100° C. of 10 cSt or greater.

In one embodiment, the hydrocracking reaction zone contains a self-supported mixed metal sulfide catalyst for hydrocracking the lubricating oil feedstock. In one embodiment, the hydrocracking reaction zone contains a hydrotreating catalyst in one catalyst layer upstream of the self-supported mixed metal sulfide catalyst in a second catalyst layer.

In one embodiment, the process provides a method for preparing a lubricating base oil having a viscosity at 100° C. of 10 cSt or greater, a VI of at least 100, a pour point of −5° C. or below and a nitrogen content of less than 20 ppm. In one embodiment, the process prepares a lubricating base oil which boils in the temperature range from 750° to 1300° F. and has a nitrogen content of less than 20 ppm.

In another embodiment, the process provides a hydrocracking process on a heavy VGO blended feedstream yielding a heavy lubricating base oil, which process includes providing a lubricating oil feedstock comprising a hydroprocessed feedstream, the feedstream having a nitrogen content of greater than 300 ppm and a sulfur content of greater than 0.1 wt. %; hydrocracking the lubricating oil feedstock with a hydrogen-containing treat gas stream in the presence of a trimetallic self-supported mixed metal sulfide hydrocracking catalyst, comprising at least a Group VIB metal selected from molybdenum and tungsten and at least a Group VIII metal selected from cobalt and nickel, at a conversion level in the range of between 10% and 50% to form a hydrocrackate; separating the hydrocrackate to form a gaseous product comprising ammonia and hydrogen sulfide, and a lubricating oil fraction boiling within a temperature range from 600° F. to 1300° F. and having a nitrogen content of less than 50 ppm; dewaxing the lubricating oil fraction in the presence of a hydrogen-containing treat gas stream over a hydroisomerization catalyst at hydroisomerization conditions, to produce a dewaxed effluent having a pour point of less than −5° C.; and providing the dewaxed effluent to a hydrofinishing reaction zone for hydrogenating the dewaxed effluent over a hydrofinishing catalyst, to form a heavy lubricating base oil having a viscosity index of greater than 95 and a viscosity at 100° C. of 10 cSt or greater.

DETAILED DESCRIPTION

The following terms will be used throughout the specification and will have the following meanings unless otherwise indicated.

A "middle distillate" is a hydrocarbon product having a boiling range in the temperature range from 250° F. to 1100° F. (121° C. to 593° C.). The term "middle distillate" includes the jet fuel, kerosene, diesel, heating oil boiling range fractions. It may also include a portion of naphtha or light oil. A "jet fuel" is a hydrocarbon product having a boiling range in the jet fuel boiling range. The term "jet fuel boiling range" refers to hydrocarbons having a boiling range in the temperature range from 280° F. to 572° F. (138° C. to 300° C.). The term "diesel fuel boiling range" refers to hydrocarbons having a boiling range in the temperature range from 250° F. to 1000° F. (121° C. to 538° C.). Boiling point properties are used herein are normal boiling point temperatures, based on ASTM D2887-08. The "boiling range" is the temperature range between the 5 vol. % boiling point temperature and the 95 vol. % boiling point temperature, inclusive of the end points, as measured by ASTM D2887-08 ("Standard Test Method for Boiling Range Distribution of Petroleum Fractions by Gas Chromatography").

A "vacuum gas oil" is a distillate fraction from a vacuum distillation. In one embodiment, the vacuum gas oil boils within a temperature range greater than 450° F. (232° C.); in another embodiment, within a temperature range from 450° F. to 1300° F.

An "atmospheric gas oil" is a distillate fraction from an atmospheric distillation. In one embodiment, the atmospheric gas oil boils within a temperature range greater than 250° F.; in another, within a temperature range from 250° F. to 1000° F.

A "crude oil distillate" is a distillate fraction from the distillation of a crude oil. In one embodiment, the lubricating oil feedstock contains a crude oil distillate, which has not been treated in catalytic processing prior to the process.

"Paraffin" refers to any saturated hydrocarbon compound, e.g., a paraffin having the formula $C_nH_{(2n+2)}$ where n is a positive non-zero integer.

"Normal paraffin" refers to a saturated straight chain hydrocarbon.

"Isoparaffin" refers to a saturated branched chain hydrocarbon.

"Hydroconversion" can be used interchangeably with the term "hydroprocessing" and refers to any process that is carried out in the presence of hydrogen and a catalyst. Such processes include, but are not limited to, methanation, water gas shift reactions, hydrogenation, hydrotreating, hydrodesulfurization, hydrodenitrogenation, hydrodeoxygenation, hydrodemetallation, hydrodearomatization, hydroisomerization, hydrodewaxing and hydrocracking including selective hydrocracking.

"Fouling rate" means the rate at which the hydroconversion reaction temperature needs to be raised per unit time, e.g., ° F. per 1000 hours, in order to maintain a given hydrodenitrogenation rate (e.g., nitrogen level in the upgraded products, desired hydrodenitrogenation rate, etc.).

"Isomerizing" refers to catalytic process in which a paraffin is converted at least partially into its isomer containing more branches or the reverse, e.g., a normal paraffin to an isoparaffin. Such isomerization generally proceeds by way of a catalytic route.

A "layered" or "stacked bed" catalyst system refers to two or more catalysts in a reactor system, having a first catalyst in a separate catalyst layer, bed, reactor, or reaction zone, and a second catalyst in a separate catalyst layer, bed, reactor, or reaction zone downstream, in relation to the flow of the feed, from the first catalyst.

"Molecular sieve" refers to a material having uniform pores of molecular dimensions within a framework structure, such that only certain molecules, depending on the type of molecular sieve, have access to the pore structure of the molecular sieve, while other molecules, on account of, for example, molecular size and/or reactivity, are excluded. Zeolites, crystalline aluminophosphates and crystalline silicoaluminophosphates are representative examples of molecular sieves. Non-limiting representative examples of a silicoaluminophosphate include SAPO-11, SAPO-31, and SAPO-41.

"Zeolite" refers to an aluminosilicate whose open tetrahedral framework allows ion exchange and reversible dehydration. A large number of zeolites have been found to be suitable for catalysis of hydrocarbon reactions. Non-limiting representative examples include zeolite Y, ultrastable Y, zeolite beta, ZSM-5, ZSM-11, ZSM-12, ZSM-22, ZSM-23, ZSM-34, ZSM-35, ZSM-38, ZSM-48, ZSM-50, and ZSM-57. Zeolites may include other metal oxides in addition to the aluminosilicate, in the framework structure.

"Supported catalyst" refers a catalyst in which the active components, e.g., Group VIII and Group VIB metals or compounds thereof, are deposited on a carrier or support.

"Self-supported catalyst" can be used interchangeably with "unsupported catalyst", "bulk catalyst", or "cogel catalyst", meaning that the catalyst composition is not of the conventional catalyst form which has a preformed, shaped catalyst support which is then loaded with metal compounds via impregnation or deposition. Likewise, "self-supported catalyst precursor" can be used interchangeably with "unsupported catalyst precursor", "bulk catalyst precursor" or "cogel catalyst precursor". In one embodiment, the self-supported catalyst is formed through precipitation. In another embodiment, the self-supported catalyst has a binder incorporated into the catalyst composition. In yet another embodiment, the self-supported catalyst is formed from metal compounds and without any binder. As used herein, the mixed metal sulfide catalyst and "MMS" catalyst are used interchangeably with the self-supported mixed metal sulfide catalyst.

"Catalyst precursor" in one embodiment refers to a compound containing at least a metal selected from Group IIA, Group IIB, Group IVA, Group VIII metals and combinations thereof (e.g., one or more Group IIA metals, one or more Group IIB metals, one or more Group IVA metals, one or more Group VIII metals, and combinations thereof); at least a Group VIB metal; and, optionally, one or more organic oxygen-containing promoters, and which compound can be used directly in the upgrade of a renewable feedstock (as a catalyst), or can be sulfided for use as a sulfided hydroprocessing catalyst.

"Group IIA" or "Group IIA metal" refers to beryllium (Be), magnesium (Mg), calcium (Ca), strontium (Sr), barium (Ba), radium (Ra), and combinations thereof in any of elemental, compound, or ionic form.

"Group IIB" or "Group IIB metal" refers to zinc (Zn), cadmium (Cd), mercury (Hg), and combinations thereof in any of elemental, compound, or ionic form.

"Group IVA" or "Group IVA metal" refers to germanium (Ge), tin (Sn) or lead (Pb), and combinations thereof in any of elemental, compound, or ionic form.

"Group VIB" or "Group VIB metal" refers to chromium (Cr), molybdenum (Mo), tungsten (W), and combinations thereof in any of elemental, compound, or ionic form.

"Group VIII" or "Group VIII metal" refers to iron (Fe), cobalt (Co), nickel (Ni), ruthenium (Ru), rhodium (Ro), palladium (Pd), osmium (Os), iridium (Ir), platinum (Pt), and combinations thereof in any of elemental, compound, or ionic form.

The Periodic Table of the Elements refers to the version published by the CRC Press in the *CRC Handbook of Chemistry and Physics,* 88th Edition (2007-2008). The names for families of the elements in the Periodic Table are given here in the Chemical Abstracts Service (CAS) notation.

As used herein, "lubricating base oil" refers to a liquid product fraction from a hydroprocessing stage having a boiling range of generally greater than 400° F., a viscosity of greater than 2 cSt at 100° C., a VI of greater than 95, a nitrogen content of less than 20 ppm and a sulfur content of less than 20 ppm.

As used herein, the extent of "conversion" relates to the percentage of the feed boiling above a reference temperature (e.g., 700° F.) which is converted to products boiling below the reference temperature. At a target temperature of 700° F., conversion is defined as:

$$[(\text{Wt. \% } 700^\circ \text{ F.}^+_{(feed)} - \text{Wt. \% } 700^\circ \text{ F.}^+_{(product)} / \text{Wt. \% } 700^\circ \text{ F.}^+_{(feed)}] \times 100$$

As used herein, the derivation of viscosity index is described in ASTM D2270-86. The viscosity index is based on measured viscosities at 40° C. and at 100° C. The viscosity of waxy oils at 40° C. may be estimated, for example, using an extrapolation method described in ASTM D341-89 from measured viscosities at 70° C. and 100° C.

Unless otherwise specified, the viscosity index as used herein is on an as is basis. A viscosity index that was specified as being on a dewaxed oil basis was determined on an oil that had been solvent dewaxed prior to the viscosity index determination. A solvent dewaxing procedure suitable for determining viscosity index (dewaxed basis) is as follows: 300 grams of a waxy oil for which a viscosity index (dewaxed basis) was to be determined was diluted 50/50 by volume with a 4:1 mixture of methyl ethyl ketone and toluene which had been cooled to −20° C. The mixture was cooled at −15° C., preferably overnight, and then filtered through a Coors funnel at −15° C. using Whatman No. 3 filter paper. The wax was removed from the filter and placed in a tarred 2 liter flask. The solvent was then removed on a hot plate and the wax weighed. The viscosities of the dewaxed oil, measured at 40° C. and 100° C., were used to determine the viscosity index.

"Promoter" refers to an organic agent that interacts strongly with inorganic agents (either chemically or physically) in a reaction to form a catalyst or a catalyst precursor, leading to alterations in the structure, surface morphology and composition, which in turn results in enhanced catalytic activity.

"Presulfiding" or "presulfided" refers to the sulfidation of a catalyst precursor in the presence of a sulfiding agent such as $H_2S$ or dimethyl disulfide (DMDS) under sulfiding conditions, prior to contact with a feedstock in an upgrade process.

As used herein, a "single reaction stage" contains a single catalyst material (e.g., same composition, shape, size, dilution, etc.) and is operated under the same reaction conditions (e.g., the same temperature or pressure, or the same degree of catalyst density, etc.) throughout its entire volume. A single reaction stage may be contained within a single reactor vessel, or multiple reaction vessels in series with liquid communication between a reaction vessel and its adjacent downstream vessel (if any), and without product recover or external heating between reactor vessels. As used herein, the term "stage" and the term "zone" are used interchangeably, unless otherwise specified.

The lubricating oil feedstock is an organic material that is principally hydrogen and carbon, with smaller amounts of heteroatoms such as nitrogen, oxygen and sulfur, and, in some cases, also containing small amounts (i.e. less than 100 ppm) of metals. The feedstock may come from one of a variety of sources, including, but not limited to, petroleum crude oil, shale oil, liquefied coal or products from processing one or more of these sources. One exemplary process is a distillation process; products may include one or a more of straight run gas oils, atmospheric gas oils, vacuum gas oils and reduced crudes. Another exemplary process is a coking process, producing coker gas oils. Another exemplary process is a hydroprocess, producing hydrotreated oils, hydrocracked oils, and cracked cycle oils. Another exemplary process is a deasphalting process, producing deasphalted residua. Another process is an FCC process, producing cycle oils and FCC tower bottoms. In general, the feedstock can be any carbon-containing feedstock susceptible to hydroprocessing catalytic reactions, particularly hydrocracking. The sulfur, nitrogen and saturate contents of these feedstocks will vary depending on a number of factors.

In one embodiment, the lubricating oil feedstock contains a hydroprocessed feedstream, which has undergone one or more hydroprocesses prior to the process of the invention. Exemplary hydroprocesses include hydrocracking, hydrotreating, isomerization, hydroisomerization, hydrogenation, alkylation or reforming. Exemplary sources of the hydroprocessed feedstream include crude oil, crude oil distillates, heavy oils, residual oils, deasphalted residua, solvent extracted lubricating oil stock, recycle petroleum fractions shale oil, liquefied coal, tar sand oil, and coal tar distillates. In one embodiment, the hydroprocessed feedstream is a hydrotreated crude oil distillate; in another embodiment, a hydrocracked crude oil distillate; in another embodiment, a hydrocracked deasphalted residuum; and in another embodiment, a hydrotreated coker gas oil.

The boiling range of the hydroprocessed feedstream is within a temperature range from 500° F. to 1300° F.; the sulfur content is greater than 100 ppm; the nitrogen is greater than 100 ppm; the viscosity at 100° C. is within a range from 2 cSt to 30 cSt. In one embodiment, properties of the hydroprocessed feedstream include a density in a range from 0.85 to 0.95 g/cm$^3$, a nitrogen content in a range from 200 to 2000 ppm, a sulfur content in a range from 0.05 wt. % to 3 wt. %, and a viscosity at 100° C. in a range from 10 cSt to 30 cSt. In another embodiment, properties of the hydroprocessed feedstream include a density in a range from 0.85 to 0.95 g/cm$^3$, a nitrogen content in a range from 300 to 2000 ppm, a sulfur content in a range from 0.1 wt. % to 2 wt. %, and a viscosity at 100° C. in a range from 10 cSt to 20 cSt. In a further embodiment, the nitrogen content is in the range from 500 to 2000 ppm and the sulfur content is in a range from 0.2 to 2 wt. %.

In another embodiment, the lubricating oil feedstock contains a crude oil distillate fraction which is derived from distillation of a crude oil, wherein neither the crude oil, nor its distillate fraction, is hydroprocessed before the process of the invention. The crude oil distillate fraction boils in a temperature range from 500° F. to 1300° F., with a density in a range from 0.85 to 1.0 g/cm$^3$, a nitrogen content in a range from 500 ppm to 3000 ppm, a sulfur content in a range from 0.05% to 4%, a viscosity at 100° C. in a range from 3 cSt to 30 cSt. In one embodiment, the crude distillate fraction boils in a temperature range from 600° F. to 1300° F., with a density in a range from 0.9 to 1.0 g/cm$^3$, a nitrogen content in a range from 700 ppm to 2000 ppm, a sulfur content in a range from 0.1 wt. % to 3 wt., and a viscosity at 100° C. in a range from 10 cSt to 20 cSt.

In another embodiment, the lubricating oil feedstock is a blend of a crude oil distillate and a hydroprocessed feedstream. In further embodiments, the lubricating oil feedstock comprises up 50 wt. %, or up to 60 wt. %, or up to 70 wt. %, or up to 80 wt. %, or up to 90 wt. %, or up to 95 wt. %, or up to 99 wt. % of the crude oil distillate. In a further embodiment, the weight ratio of the crude oil distillate to the hydroprocessed feedstream is within the range from 99:1 to 80:20.

The lubricating oil feedstock will generally boil in a temperature range from 500° F. to 1300° F., with a density in a range from 0.85 to 1.0 g/cm$^3$, a nitrogen content in a range from 500 ppm to 3000 ppm, a sulfur content in a range from 0.05% to 4%, a viscosity at 100° C. in a range from 3 cSt to 30 cSt. In one embodiment, the crude distillate fraction boils in a temperature range from 600° F. to 1300° F., with a density in a range from 0.9 to 1.0 g/cm$^3$, a nitrogen content in a range from 700 ppm to 2000 ppm, a sulfur content in a range from 0.1 wt. % to 3 wt., and a viscosity at 100° C. in a range from 10 cSt to 20 cSt.

The lubricating oil feedstock is processed in one or more hydroprocessing steps to prepare the lubricating base oil. In general, the hydroprocessing step is a step of converting at least a fraction of the lubricating oil feedstock, by contacting the feedstock in the presence of free hydrogen at reaction conditions with a hydroprocessing catalyst.

In one embodiment, the process comprises hydrocracking a lubricating oil feedstock with a self-supported mixed metal sulfide catalyst and producing lubricating oil fraction for dewaxing, in the preparation of a lubricating base oil. The hydroprocess can be practiced in one or more reaction zones, and can be practiced in either countercurrent flow or co-current flow mode. By countercurrent flow mode is meant a process wherein the feed stream flows countercurrent to the flow of hydrogen-containing treat gas. The hydroprocessing may also include slurry and ebullating bed processes for the removal of sulfur and nitrogen compounds and the hydrogenation of aromatic molecules present in light fossil fuels such as petroleum mid-distillates.

The hydroprocessing process can be single staged or multiple-staged. In one embodiment, the process is a two stage system wherein the first and second stages employ different catalysts, and wherein at least one of the catalysts used in the system is the self-supported mixed metal sulfide catalyst.

In one embodiment, the hydroprocess includes a hydrocracking process, including contacting the lubricating oil feedstock with a self-supported mixed metal sulfide catalyst at hydrocracking reactions conditions. In another embodiment, the hydroprocess includes a hydrotreating process, including contacting the lubricating oil feedstock with a self-supported mixed metal sulfide catalyst at hydrotreating reaction conditions. In another embodiment, the hydroprocess is a multi-stage process, including contacting the hydrocarbon fraction with a self-supported mixed metal sulfide catalyst at hydrotreating reaction conditions to form at least one partially upgraded liquid product, and contacting the partially upgraded product with a second self-supported mixed metal sulfide catalyst at hydrocracking reaction conditions. In another embodiment, the feedstock is prepared by a combination of hydrotreating and hydrocracking, in any order.

The self-supported mixed metal sulfide catalyst can be applied in any reactor type. In one embodiment, the catalyst is applied to a fixed bed reactor. In another embodiment, two or more reactors containing the catalyst can be used in series. In another embodiment, the catalyst is used as a slurry in a slurry reaction zone.

In one embodiment, the mixed metal sulfide catalyst is used in a fixed bed hydroprocessing reactor by itself. In another embodiment, the mixed metal sulfide catalyst is used in conjunction with at least a different catalyst in a fixed bed reactor, wherein the catalysts are packed in a stacked-bed manner. In one embodiment, the mixed metal sulfide catalyst is employed in a layered/graded system, with a first layer catalyst having a larger pore size, and the second layer being an embodiment of the mixed metal sulfide catalyst of the invention. In one embodiment, the mixed metal sulfide catalyst is employed in a layered/graded system, in combination with a zeolite or molecular sieve containing catalyst in the stacked bed, in any order within the stacked bed. In one embodiment, the mixed metal sulfide catalyst is employed in a layered/graded system in the absence of a zeolite or molecular sieve.

In one embodiment, the stacked bed catalyst system includes a first hydrotreating catalyst layer and a second hydrocracking catalyst layer downstream, in relation to the flow of the feed, from the first catalyst layer. The mixed metal sulfide catalyst may be included in the hydrotreating catalyst layer, the hydrocracking catalyst layer, or in both. In one embodiment, the first hydrotreating catalyst layer and the second hydrocracking catalyst layer are contained within a single reaction vessel, without intermediate separation and product recovery of the hydrotreated effluent, prior to passing the effluent to the hydrocracking catalyst layer.

In one embodiment wherein the mixed metal sulfide catalyst prepared from the catalyst precursor is used in a layered bed system, the mixed metal sulfide catalyst comprises at least 10 vol. % of the total catalyst. In a second embodiment, the mixed metal sulfide catalyst comprises at least 25 vol. % of the catalyst system. In a third embodiment, the mixed metal sulfide catalyst comprises at least 35 vol. % of the layered catalyst system. In a fourth embodiment, the mixed metal sulfide catalyst comprises at least 50 vol. % of a layered bed system. In a fifth embodiment, the mixed metal sulfide catalyst comprises 80 vol. % of a layered bed system. In a sixth embodiment, the layered catalyst system contains the hydrotreating catalyst and the hydrocracking catalyst in a weight ratio within the range 1:10 to 10:1.

In one embodiment, the lubricating oil feedstock is treated in the process with one or more non-zeolitic catalysts, in the absence of catalytically active amounts of a zeolite or molecular sieve, to produce the lubricating base oil. By "non-zeolitic" is meant that the stacked bed catalyst system contains no more than impurity levels (e.g. less than 1 wt. %, or less than 0.1 wt. %) of a zeolite or molecular sieve.

In one embodiment, the hydroprocess is a hydrocracking process, including contacting a lubricating oil feedstock with a self-supported mixed metal sulfide catalyst at hydrocracking reaction conditions, and recovering a dewaxer feedstock.

The hydrocracking processes using self-supported mixed metal sulfide catalysts can be suitable for making lubricating oil base stocks meeting Group II or Group III base oil requirements. In one embodiment, the catalyst is used in preparing a catalyst for use in a hydroprocessing process producing white oils. White mineral oils, called white oils, are colorless, transparent, oily liquids obtained by the refining of crude petroleum feedstocks.

The hydrocracking reaction zone is maintained at conditions sufficient to effect a boiling range conversion of the feedstock to the hydrocracking reaction zone, so that the liquid hydrocrackate recovered from the hydrocracking reaction zone has a normal boiling point range below the boiling point range of the feedstock. The hydrocracking step reduces the size of the hydrocarbon molecules, hydrogenates olefin bonds, hydrogenates aromatics, and removes traces of heteroatoms resulting in an improvement in base oil product quality. Typically, the hydrocracking reaction zone is operated at conditions such that at least 10 wt. % of the lubricating oil feedstock is converted to hydrocarbon products which boil below the initial boiling point of the feedstock. In one embodiment, in the range from 10 wt. % to 90 wt. %; in another embodiment in a range from 10 wt. % to 75 wt. %; in another embodiment in a range from 10 wt. % to 50 wt. %; in another embodiment in a range from 15 wt. % to 50 wt. % of the lubricating oil feedstock is converted into hydrocrackate which boils below the initial boiling point of the feedstock. Hydrocracking conversion may also be referenced to a reference temperature, such as 700° F. (371° C.). In one embodiment, hydrocracking conversion in the hydrocracking reaction zone is in a range from 10 wt. % to 90 wt. %; in another embodiment in a range from 10 wt. % to 75 wt. %; in another embodiment in a range from 10 wt. % to 50 wt. %; in another embodiment in a range from 15 wt. % to 50 wt. %.

The conditions of the hydrocracking reaction zone can vary according to the nature of the feedstock, the intended quality of the products, and the particular facilities of each refinery. Hydrocracking reaction conditions include, for example, a temperature of from 450° F. to 900° F. (232° C. to 482° C.), e.g., from 650° F. to 850° F. (343° C. to 454° C.); a pressure of from 500 psig to 5000 psig (3.5 MPa to 34.5 MPa gauge), e.g., from 1500 psig to 3500 psig (10.4 MPa to 24.2 MPa gauge); a liquid reactant feed rate, in terms of liquid hourly space velocity (LHSV) of from 0.1 $hr^{-1}$ to 15 $hr^{-1}$ (v/v), e.g., from 0.25 $hr^{-1}$ to 2.5 $hr^{-1}$; and a hydrogen feed rate, in terms of $H_2$/hydrocarbon ratio, of from 500 SCF/bbl to 5000 SCF/bbl (89 to 890 $m^3$ $H_2/m^3$ feedstock) of liquid lubricating oil feedstock. The hydrocracked stream can then separated into various boiling range fractions. The separation is typically conducted by fractional distillation preceded by one or more vapor-liquid separators to remove hydrogen and/or other tail gases. Fractional distillation can include atmospheric distillation, vacuum distillation, or both.

The hydrocracking reaction zone that contains the mixed metal sulfide hydrocracking catalyst can be contained within a single reactor vessel, or it can be contained in two or more reactor vessels, connected together in fluid communication in a serial arrangement. In some embodiments, hydrogen and the feedstock are provided to the hydrocracking reaction zone in combination. Additional hydrogen can be provided at various locations along the length of the reaction zone to maintain an adequate hydrogen supply to the zone. Furthermore, relatively cool hydrogen added along the length of the reactor can serve to absorb some of the heat energy within the zone, and help to maintain a relatively constant temperature profile during the exothermic reactions occurring in the reaction zone. Processes with two or more hydrocracking reactors in a serial arrangement may include a fractionation step between two of the reactors. One or more liquid fractions from the fractionation step may be used as feed to the second (or downstream) hydrocracking reactor. In one embodiment, hydrocrackate from a second hydrocracking reactor is recycled to a fractionation step between hydrocracking reactors; a bottoms fraction from the fractionator is then used as feed to the second hydrocracking reactor.

Processing the lubricating oil feedstock at hydrocracking conditions includes hydrocracking the lubricating oil feedstock with a hydrogen-containing treat gas over a hydrocracking catalyst. The catalyst in the hydrocracking reaction zone is the self-supported mixed metal sulfide catalyst. In one embodiment, multiple catalyst types may be blended in the reaction zone, or they can be layered in separate catalyst layers to provide a specific catalytic function that provides improved operation or improved product properties. Layered catalyst systems are taught, for example, in U.S. Pat. Nos. 4,990,243 and 5,071,805. The catalyst may be present in the reaction zone in a fixed bed configuration, with the feedstock passing either upward or downward through the zone. In some embodiments, the feedstock passes co-currently with the hydrogen feed within the zone. In other embodiments, the feedstock passes countercurrent to the hydrogen feed within the zone.

In one embodiment, the self-supported mixed metal sulfide catalyst is layered in the hydrocracking reaction zone with a second hydrocracking catalyst. The second hydrocracking catalyst generally comprises a cracking component, a hydrogenation component and a binder. Such catalysts are well known in the art. The cracking component can include an amorphous silica/alumina phase and/or a zeolite, such as a Y-, USY-, or FAU-type zeolite, beta or BEA-type zeolite, ZSM-48 or MRE-type zeolite, ZSM-12 or MTW-type zeolite. If present, the zeolite is at least about 1% by weight based on the total weight of the catalyst. A zeolite-containing hydrocracking catalyst generally contains in the range of from 1 wt. % to 99 wt. % zeolite (e.g., from 2 wt. % to 70 wt. % zeolite). Actual zeolite amounts will, of course, be adjusted to meet catalytic performance requirements. The binder is generally silica or alumina. The hydrogenation component will be a Group VI, Group VII, or Group VIII metal or oxides or sulfides thereof, usually one or more of molybdenum, tungsten, cobalt, or nickel, or the sulfides or oxides thereof. If present in the catalyst, these hydrogenation components generally make up from 5% to 40% by weight of the catalyst. Alternatively, platinum group metals, especially platinum and/or palladium, can be present as the hydrogenation component, either alone or in combination with the base metal hydrogenation components molybdenum, tungsten, cobalt, or nickel. If present, the platinum group metals will generally make up from 0.1% to 2% by weight of the catalyst.

In one embodiment, the mixed metal sulfide catalyst is characterized as being less susceptible to fouling, i.e., having a lower fouling rate, compared to the catalysts of the prior art when employed in hydrocracking processes.

In one embodiment, the mixed metal sulfide catalyst is layered upstream of the second hydrocracking catalyst with respect to the direction of liquid flow through the reaction zone; in another embodiment, the mixed metal sulfide catalyst is layered downstream of the second hydrocracking catalyst. In a further embodiment, one or more additional layers of catalytic material, or material that is inert to reactions in the reaction zone, may be included between the mixed metal sulfide catalyst and the second hydrocracking catalyst. The amount of the mixed metal sulfide catalyst which may be present in the layered catalyst system is sufficient to affect rates and levels of conversion within the reaction zone. In one embodiment, the weight ratio of mixed metal sulfide catalyst to the second hydrocracking catalyst is between 1:99 and 99:1; in another embodiment, between 5:95 and 95:5; in another embodiment, between 10:90 and 90:10; in another embodiment, between 20:80 and 80:20.

In another embodiment, the mixed metal sulfide catalyst is layered with one or more hydrotreating catalysts, for cleaning the feed or for removing sulfur and nitrogen from the feed or for removing metals from the feed or for removing residual reactive molecules from the feed upstream of the mixed metal sulfide catalyst in the hydrocracking reaction zone. In one embodiment, a single hydrotreating catalyst is employed. In another embodiment, at least two hydrotreating catalyst layers are used, with a first layer comprising a large pore size hydrotreating catalyst (e.g. having pore diameters of 80 angstroms or greater), and a second layer comprising an intermediate pore size hydrotreating catalyst (e.g. having pore diameters of 100 angstroms or less) with an average pore diameter that is smaller than the average pore diameter of the large pore size hydrotreating catalyst. When a hydrotreating catalyst is employed in a layered hydrocracking catalyst system, the volumetric ratio of the mixed metal sulfide hydrocracking catalyst to the hydrotreating catalyst is in a range from 1:99 to 99:1. In one embodiment, the volumetric ratio is in a range from 70:30 to 95:5; in another embodiment, the volumetric ratio is in a range from 75:25 to 55:45.

The mixed metal sulfide catalyst used in the hydrocracking process has a lower fouling rate than conventional hydrocracking catalysts, including zeolite-containing hydrocracking catalysts, when used to hydrocracking difficult feeds, including feeds having, for example, high nitrogen content or high asphaltenic content or high aromatic content or high polycyclic aromatic content or a combination of these refractory elements. Thus, surprising results is particularly evident when hydrocracking feedstocks to make a heavy lubricating base oil, such as a base oil having a viscosity at 100° C. of 10 cSt or greater, or, in another embodiment, a heavy lubricating base oil having a viscosity at 100° C. of 12 cSt or greater.

Thus, in one embodiment, a catalyst system employing the mixed metal sulfide catalyst in a hydrocracking reaction system has a fouling rate of less than 8° F. (4.4° C.) per 1000 hour, i.e., that is, the catalytic reactor temperature needs to be increased no more than 8° F. per 1000 hour in order to maintain a target nitrogen level of 2 ppm in the upgraded products of a hydrodenitrogenation (HDN) process. The feedstock in this accelerated fouling process is vacuum gas oil (VGO) having properties of 14.08 cSt viscosity at 100° C., 0.94 g/cm$^3$ density, 407-574° C. boiling range, and 1.69 hydrogen to carbon atomic ratio. The process condition includes a temperature of 366°-388° C., 14.5 MPa pressure, 0.65 hr$^{-1}$ LHSV, and hydrogen flow rate of 5000 scfb (890 m$^3$ $H_2$/m$^3$ liquid feedstock). The HDN target is a nitrogen level of 2 ppm in the upgraded products.

The total effluent from the hydrocracking reaction zone may be fractionated prior to dewaxing. Suitable fractionation processes include flash separation, single-stage separation, including using a flowing gaseous stream as a stripping medium, atmospheric distillation (i.e., distillation at atmospheric or superatmospheric pressure), vacuum distillation (i.e., distillation at subatmospheric pressure), alone or in combination, in any order. The dewaxer feed which is recovered from the separation may be a distillate fraction or a residuum fraction from the distillation.

The hydrocrackate which is the effluent from the hydrocracking reaction zone comprises at least a gaseous product that contains ammonia and a liquid fraction that boils above the initial boiling point of the lubricating oil feedstock. The gaseous product may also contain hydrogen sulfide and unreacted hydrogen; at least a portion of the unreacted hydrogen is often purified, including separated from ammonia and hydrogen sulfide, and returned to the hydrocracking reaction zone as hydrogen recycle. In one embodiment, the hydrocrackate comprises a least two liquid fractions, one of which boils in a temperature range above the initial boiling point of the lubricating oil feedstock, and a second liquid fraction, at least a portion of which boils above the initial boiling point of the feedstock.

In one embodiment, the hydrocrackate is passed to a first single-stage separation for removing normally gaseous components. Additional low boiling hydrocarbon products may also be removed, either in the same single-stage separator or in a second single-stage separator that is operated at a lower pressure than the first single-stage separator. In one embodiment, the stripped liquid fraction is further separated by atmospheric distillation, which produces at least one liquid fraction, at least a portion of which boils above the initial boiling point of the lubricating oil feedstock. In one embodiment, the liquid fraction, in its entirety boils above the initial boiling point of the lubricating oil feedstock. An exemplary liquid fraction boils within the temperature range from 550° F. to 1300° F.; a second exemplary liquid fraction from atmospheric distillation boils within a temperature range from 600° F. to 1250° F.

In another embodiment, a liquid fraction from the atmospheric distillation is further separated by vacuum distillation. Fractions producing during vacuum distillation include at least two liquid fractions, one of which boils in its entirety above the initial boiling point of the lubricating oil feedstock, and one at least a portion of which boils above the initial boiling point of the feedstock. An exemplary liquid phase fraction from vacuum distillation boils in the temperature range from 650° to 1300° F. Another exemplary liquid phase boils in the temperature range from 750° F. to 1300° F. In the exemplary situation wherein two liquid phase fractions are produced from vacuum distillation, a lighter liquid phase fraction boils within the temperature range from 500° F. to 1000° F., and a heavier liquid phase fraction boils within the temperature range from 750° F. to 1300° F. The sulfur levels of the liquid fractions from vacuum distillation are less than 50 ppm. The nitrogen levels of the liquid fractions from vacuum distillation are less than 20 ppm.

In one embodiment, preparing the lubricating base oil further comprises contacting the lubricating oil feedstock in a hydrotreating reaction zone. A hydrotreating reaction zone is generally operated at milder conditions than that of a hydrocracking reaction zone, such that cracking reactions are minimized while olefin and aromatic saturations reactions, metal removal reactions, and heteroatom removal reactions are facilitated. Frequently in feedstock applications, the hydrotreating reaction zone is controlled to a product heteroatom content. In one embodiment, the lubricating oil feedstock is hydrotreated in a hydrotreating reaction zone prior to hydrocracking. At least a portion of the effluent from the hydrotreating reaction zone is passed to the hydrocracking reaction zone. In one embodiment, the entire effluent from the hydrotreating reaction zone is passed to the hydrocracking reaction zone. In one embodiment, the process comprises two or more hydrotreating catalyst layers, followed by at least one hydrocracking layer, with an upstream layer of hydrotreating catalyst for removing metallic components and very heavy condensed molecules from the feedstock, and a downstream layer of hydrotreating catalyst for nitrogen and sulfur removal from the feedstock.

Hydrotreating is generally a catalytic process that is carried out in the presence of free hydrogen to remove or reduce impurities, including, but not limited to, hydrodesulphurization, hydrodenitrogenation, hydrodemetallation, hydrodearomatization, and hydrogenation of unsaturated compounds. Depending on the type of hydrotreating and the reaction conditions, the products of hydrotreating may show improved viscosities, viscosity indices, saturates content, low temperature properties, and volatilities for example. Generally, in hydrotreating operations cracking of the hydrocarbon molecules (i.e., breaking the larger hydrocarbon molecules into smaller hydrocarbon molecules) is minimized. For the purpose of this discussion, the term hydrotreating refers to a hydroprocessing operation in which the conversion is less than 10 wt. % or less (including less than 5 wt. %), where the extent of "conversion" relates to the percentage of the feedstock boiling above a reference temperature (e.g., 700° F.) which is converted to products boiling below the reference temperature.

Typical hydrotreating conditions vary over a wide range. In general, the overall LHSV is about 0.25 $hr^{-1}$ to 10 $hr^{-1}$ (v/v), or alternatively about 0.5 $hr^{-1}$ to 1.5 $hr^{-1}$. The total pressure is from 200 psig to 3000 psig, or alternatively ranging from about 500 psia to about 2500 psia. Hydrogen feed rate, in terms of $H_2$/hydrocarbon ratio, are typically from 500 SCF/Bbl to 5000 SCF/bbl (89 to 890 $m^3$ $H_2/m^3$ feedstock), and are often between 1000 and 3500 SCF/Bbl. Reaction temperatures in the reactor will be in the range from about 300° F. to about 750° F. (about 150° C. to about 400° C.), or alternatively in the range from 450° F. to 725° F. (230° C. to 385° C.).

In one embodiment, the process includes a hydrotreating process, including contacting a hydrocarbon fraction with a self-supported mixed metal sulfide catalyst at hydrotreating reaction conditions.

In another embodiment, the hydrotreating process includes contacting the hydrocarbon fraction with a supported hydrotreating catalyst, such as, for example, a supported, non-zeolitic catalyst. The supported hydrotreating catalyst may include noble metals from Group VIIIA (according to the 1975 rules of the International Union of Pure and Applied Chemistry), such as platinum or palladium on an alumina or siliceous matrix. Alternatively, or in combination with a noble metal Group VIIIA catalyst, the supported hydrotreating catalyst may include at least one metal component selected from the Group VI B elements or mixtures thereof and at least one metal component selected from the non-noble Group VIII elements or mixtures thereof. Group VI B elements include chromium, molybdenum and tungsten. Group VIII elements include iron, cobalt and nickel. The amount(s) of metal component(s) in the catalyst suitably range from about 0.5% to about 25% by weight of Group VIII metal component(s) and from about 0.5% to about 25% by weight of Group VI B metal component(s), calculated as metal oxide(s) per 100 parts by weight of total catalyst, where the percentages by weight are based on the weight of the catalyst before sulfiding. The total weight percent of metals employed in the hydrotreating catalyst is at least 5 wt. % in one embodiment. U.S. Pat. No. 3,852,207 describes a suitable noble metal catalyst and mild conditions. Other suitable catalysts are described, for example, in U.S. Pat. Nos. 4,157,294 and 3,904,513. The non-noble hydrogenation metals are usually prepared in the final catalyst composition as oxides, but are usually employed in their reduced or sulfided forms within the reactor at hydrotreating reaction conditions. In one embodiment, non-noble metal catalyst compositions contain in excess of about 5 weight percent, preferably about 5 to about 40 weight percent molybdenum and/or tungsten, and at least about 0.5, and generally about 1 to about 15 weight percent of nickel and/or cobalt determined as the corresponding oxides. Catalysts containing noble metals, such as platinum, contain in excess of 0.01 percent metal, preferably between 0.1 and 1.0 percent metal. Combinations of noble metals may also be used, such as mixtures of platinum and palladium.

The supported catalyst can be prepared by blending, or co-mulling, active sources of the aforementioned metals with a binder. Examples of binders include silica, silicon carbide, amorphous and crystalline silica-aluminas, silica-magnesias, aluminophosphates, boria, titania, zirconia, and the like, as well as mixtures and co-gels thereof. Preferred supports include silica, alumina, alumina-silica, and the crystalline silica-aluminas, particularly those materials classified as clays or zeolitic materials. Especially preferred support materials include alumina, silica, and alumina-silica, particularly either alumina or silica. Other components, such as phosphorous, can be added as desired to tailor the catalyst particles for a desired application. The blended components can then shaped, such as by extrusion, dried and calcined at temperatures up to 1200° F. (649° C.) to produce the finished catalyst. Alternatively, other methods of preparing the amorphous catalyst include preparing oxide binder particles, such as by extrusion, drying and calcining, followed by depositing the aforementioned metals on the oxide particles, using methods such as impregnation. The supported catalyst, containing the aforementioned metals, can then further dried and calcined prior to use as a hydrotreating catalyst.

In one embodiment, the supported catalyst is a hydroprocessing catalyst prepared as disclosed in US20090298677A1, the relevant disclosures are included herein by reference, by depositing onto a carrier having a water pore volume a composition comprising at least a Group VIB metal and at least a Group VIII metal of the Periodic Table of the Elements, optionally a phosphorus-containing acidic component, and at least a promote, deposited onto a carrier having a water pore volume, and then calcining the impregnated carrier at a temperature greater than 200° C. and lower than the decomposition temperature of the promoter. The Group VIB metal in one embodiment is selected from molybdenum Mo and tungsten W. The Group VIII metal is selected from cobalt Co and nickel Ni. The promoter is present in an amount of 0.05 to about 5 molar times of the total number of moles of the metals of Group VIB and Group VIII. In one embodiment, the molar ratio of the Group VIII metal to Group VIB metal is about 0.05 to about 0.75.

In one embodiment, the self-supported mixed metal sulfide catalyst is the sole hydrotreating catalyst in the process. In another embodiment, the self-supported mixed metal sulfide catalyst is combined with the supported hydrotreating catalyst in a single reaction zone or in multiple reaction zones, in a single reactor, or in multiple reactors. The combination of the self-supported mixed metal sulfide catalyst and the supported hydrotreating catalyst may include an intimate mixture of the two in a reaction zone, or a layered catalyst system, with each catalyst in individual reaction layers. In the layered or stacked bed system, the self-supported mixed metal sulfide catalyst may be upstream, or downstream, of the supported hydrotreating catalyst layer.

The dewaxer feed that is the at least one liquid fraction from separation of the hydrocrackate is dewaxed in the presence of a hydrogen-containing treat gas stream over a shape selective intermediate pore size molecular sieve catalyst at hydroisomerization conditions, to produce a dewaxed effluent having a pour point of less than −5° C.

A suitable dewaxer feedstock boils in a range of greater than 400° F.; it has a viscosity of greater than 2 cSt at 100°

C., a viscosity index (i.e. VI) of greater than 95, a nitrogen content of less than 20 ppm and a sulfur content of less than 20 ppm. The feedstock may have a boiling range within a temperature range of greater than 450° F., or greater than 500° F. The feedstock may further have a viscosity, measured at 100° C., of greater than 3 cSt, or greater than 3.5 cSt. In one embodiment, the feedstock is a heavy lubricating oil feedstock, having a boiling range of greater than 700° F., a viscosity greater than 10 cSt at 100° C., and a viscosity index equal to or greater than 100. In another embodiment, the heavy feedstock has a boiling range within a temperature range of 750° F. to 1300° F., a viscosity greater than 10 cSt at 100° C., and a viscosity index greater than 101. In another embodiment, the heavy feedstock has a boiling range within a temperature range of 800° F. to 1300° F., a viscosity greater than 11 cSt at 100° C., and a viscosity index greater than 101.

The concentration of sulfur in the feed for hydroisomerization dewaxing should be less than 100 ppm (e.g., less than 50 ppm or less than 20 ppm). The concentration of nitrogen in the feed for hydroisomerization dewaxing should be less than 50 ppm (e.g., less than 30 ppm or less than 10 ppm).

The dewaxing step is purposed primarily for reducing the pour point and/or for reducing the cloud point of the base oil by removing wax from the base oil. Regardless of whether the dewaxing step uses a solvent process or a catalytic process for processing the wax, the dewaxer feed is generally upgraded prior to dewaxing to increase the viscosity index, to decrease the aromatic and heteroatom content, and to reduce the amount of low boiling components in the dewaxer feed. Some dewaxing catalysts accomplish the wax conversion reactions by cracking the waxy molecules to lower molecular weight molecules. Other dewaxing process convert the wax contained in the hydrocarbon feed to the process by wax isomerization, to produce isomerized molecules that have a lower pour point than the non-isomerized molecular counterparts. As used herein, isomerization encompasses a hydroisomerization process, for using hydrogen in the isomerization of the wax molecules under catalytic hydroisomerization conditions.

The dewaxing step includes processing the dewaxer feedstock by hydroisomerization to convert at least the n-paraffins and to form an isomerized product comprising isoparaffins. Suitable isomerization catalysts for use in the dewaxing step can include, but are not limited to, Pt and/or Pd on a support. Suitable supports include, but are not limited to, zeolites CIT-1, IM-5, SSZ-20, SSZ-23, SSZ-24, SSZ-25, SSZ-26, SSZ-31, SSZ-32, SSZ-32, SSZ-33, SSZ-35, SSZ-36, SSZ-37, SSZ-41, SSZ-42, SSZ-43, SSZ-44, SSZ-46, SSZ-47, SSZ-48, SSZ-51, SSZ-56, SSZ-57, SSZ-58, SSZ-59, SSZ-60, SSZ-61, SSZ-63, SSZ-64, SSZ-65, SSZ-67, SSZ-68, SSZ-69, SSZ-70, SSZ-71, SSZ-74, SSZ-75, SSZ-76, SSZ-78, SSZ-81, SSZ-82, SSZ-83, SSZ-86, SUZ-4, TNU-9, ZSM-5, ZSM-12, ZSM-22, ZSM-23, ZSM-35, ZSM-48, EMT-type zeolites, FAU-type zeolites, FER-type zeolites, MEL-type zeolites, MFI-type zeolites, MTT-type zeolites, MTW-type zeolites, MWW-type zeolites, MRE-type zeolites, TON-type zeolites, other molecular sieves materials based upon crystalline aluminophosphates such as SM-3, SM-7, SAPO-11, SAPO-31, SAPO-41, MAPO-11 and MAPO-31. In some embodiments, the step of isomerizing involves a Pt and/or Pd catalyst supported on an acidic support material selected from the group consisting of beta or zeolite Y molecular sieves, silica, alumina, silica-alumina, and combinations thereof. For other suitable isomerization catalysts, see, e.g., U.S. Pat. Nos. 4,859,312; 5,158,665; and 5,300,210.

The hydroisomerizing conditions depend on the feed used, the hydroisomerization catalyst used, whether or not the catalyst is sulfided, the desired yield, and the desired properties of the lubricating base oil. Useful hydroisomerizing conditions include a temperature of from 500° F. to 775° F. (260° C. to 413° C.); a pressure of from 15 psig to 3000 psig (0.10 MPa to 20.68 MPa gauge); a LHSV of from 0.25 $hr^{-1}$ to 20 $hr^{-1}$; and a hydrogen to feed ratio of from 2000 SCF/bbl to 30,000 SCF/bbl (356 to 5340 $m^3$ $H_2/m^3$ feed). Generally, hydrogen will be separated from the product and recycled to the isomerization zone.

A general description of suitable hydroisomerization dewaxing processes can be found in U.S. Pat. Nos. 5,135,638; 5,282,958; and 7,282,134.

With regard to the catalytic isomerization step described above, in some embodiments, the methods described herein can be conducted by contacting the normal paraffins contained in the pretreated dewaxer feed with a fixed stationary bed of catalyst, with a fixed fluidized bed, or with a transport bed. In one embodiment, a trickle-bed operation is employed, wherein such feed is allowed to trickle through a stationary fixed bed, typically in the presence of hydrogen. For an illustration of the operation of such catalysts, see, U.S. Pat. Nos. 6,204,426 and 6,723,889, the relevant disclosures are incorporated herein by reference.

In some embodiments, the isomerized product comprises at least 10 wt. % isoparaffins (e.g., at least 30 wt. %, 50 wt. %, or 70 wt. % isoparaffins). In some embodiments, the isomerized product has an isoparaffin to normal paraffin mole ratio of at least 5:1 (e.g., at least 10:1, 15:1, or 20:1).

In some embodiments, the isomerized product boils in a range of greater than 400° F.; it has a viscosity of greater than 2 cSt at 100° C., a viscosity index (i.e. VI) of greater than 95, a nitrogen content of less than 20 ppm and a sulfur content of less than 20 ppm. The product may have a boiling range within a temperature range of greater than 450° F., or greater than 500° F. The product may further have a viscosity, measured at 100° C., of greater than 3 cSt, or greater than 3.5 cSt. The product may further have a pour point of less than 0° C. In one embodiment, the lubricating base oil has a boiling range of greater than 700° F., a viscosity greater than 10 cSt at 100° C., a viscosity index equal to or greater than 100 and a pour point of less than −8° C. In another embodiment, the lubricating base oil has a boiling range within a temperature range of 750° F. to 1300° F., a viscosity greater than 10 cSt at 100° C., and a viscosity index greater than 101. In another embodiment, the heavy feedstock has a boiling range within a temperature range of 800° F. to 1300° F., a viscosity greater than 11 cSt at 100° C., a viscosity index greater than 101 and a pour point of less than −8° C.

In some embodiments, the isomerized product is suitable (or better suited) for use as a lubricating base oil. In some such embodiments, the isomerized product is mixed or admixed with existing lubricating base oils in order to create new base oils or to modify the properties of existing base oils. Isomerization and blending can be used to modulate and maintain pour point and cloud point of the base oil at suitable values. In some embodiments, the normal paraffins are blended with other species prior to undergoing catalytic isomerization. In some embodiments, the normal paraffins are blended with the isomerized product.

The lubricating base oil that is produced in the dewaxing step may be treated in a separation step to remove light product. The lubricating base oil may be further treated by distillation, using atmospheric distillation and optionally vacuum distillation to produce a lubricating base oil.

The lubricating base oil that is produced in the dewaxing step can optionally be hydrofinished, to improve the oxidation stability, UV stability, and appearance of the product by removing aromatics, olefins, color bodies, and solvents. Hydrofinishing is typically conducted in a hydrofinishing reaction zone using a hydrofinishing catalyst at a temperature of from 300° F. to 600° F. (149° C. to 316° C.); a pressure of from 400 psig to 3000 psig (2.76 MPa to 20.68 MPa gauge); a LHSV of from 0.1 $hr^{-1}$ to 20 $hr^{-1}$, and a hydrogen recycle rate of from 400 SCF/bbl to 1500 SCF/bbl (71 to 267 m3 H2/m3 feed). The hydrofinishing catalyst employed must be active enough not only to hydrogenate the olefins, diolefins and color bodies within the lube oil fractions, but also to reduce the aromatic content (color bodies). The hydrofinishing step is beneficial in preparing acceptably stable lubricating oil. Suitable hydrofinishing catalysts include conventional metallic hydrogenation catalysts, particularly the Group VIII metals such as cobalt, nickel, palladium and platinum. The metals are typically associated with carriers such as bauxite, alumina, silica gel, silica-alumina composites, and crystalline aluminosilicate zeolites. Palladium is a particularly useful hydrogenation metal. If desired, non-noble Group VIII metals can be used with molybdates. Metal oxides or sulfides can be used. Suitable catalysts are disclosed in U.S. Pat. Nos. 3,852,207; 3,904,513; 4,157,294; and 4,673,487.

Additionally, U.S. Pat. No. 6,337,010 discloses a process scheme for producing lubricating base oil using low pressure dewaxing and high pressure hydrofinishing and discloses operating conditions for lube hydrocracking, isomerization and hydrofinishing that can be useful herein.

Effluent from the hydrofinishing reaction zone may be fractionated. A fractionator that may be used is selected from a single stage flash separation, a stripper, an atmospheric distillation, a vacuum distillation and combinations thereof.

The hydrogen is generally supplied at superatmospheric pressures, including a pressure in the range from 1 atmosphere to 250 atmospheres. Typically, hydrogen is supplied in gaseous form, though in some embodiments, hydrogen dissolved in a chemical or physical solution is supplied to the hydroprocess.

In one embodiment, the lubricating base oil that is prepared in the process is used without further processing as a lubricating base oil. In another embodiment, the process is a pretreatment process for preparing a base oil that is further converted in another hydroprocess, such as, for example, a hydrocracking process, a dewaxing process, an isomerization process, a hydroisomerization process, a hydrotreating process or a hydrofinishing process. As an illustrative embodiment, The lubricating base oil following hydrofinishing as described herein has a kinematic viscosity at 100° C. of at least 3 $mm^2/s$. In one embodiment, the kinematic viscosity at 100° C. is 10 $mm^2/s$ or greater. In one embodiment, the kinematic viscosity at 100° C. is 11 $mm^2/s$ or greater; in another embodiment 12 $mm^2/s$ or greater; in another embodiment in a range from 10 $mm^2/s$ and 16 $mm^2/s$. The lubricating base oil has a pour point of −5° C. or below (e.g., −10° C. or below, or −15° C. or below). The VI is usually at least 100 (e.g., at least 110, at least 115 or at least 120). In one embodiment, the VI of the lubricating base oil product is from 100 to 119. In one embodiment, the lubricating base oil has a kinematic viscosity at 100° C. of from 10 $mm^2/s$ to 16 $mm^2/s$, a pour point of −15° C. or less, and a VI of at least 101. The cloud point of the lubricating base oil is usually 0° C. or below. The sulfur content of the lubricating base oil is less than 20 ppm and the nitrogen content of the lubricating base oil is less than 20 ppm.

In one embodiment, the lubricating base oil is a Group II+ base oil. In another embodiment, the lubricating base oil is a Group III base oil. The term "Group II base oil" refers to a base oil which contains greater than or equal to 90% saturates and less than or equal to 0.03% sulfur and has a viscosity index greater than or equal to 80 and less than 120 using the ASTM methods specified in Table E-1 of American Petroleum Institute Publication 1509. The term "Group II+ base oil" refers to a Group II base oil having a viscosity index greater than or equal to 110 and less than 120. The term "Group III base oil" refers to a base oil which contains greater than or equal to 90% saturates and less than or equal to 0.03% sulfur and has a viscosity index greater than or equal to 120 using the ASTM methods specified in Table E-1 of American Petroleum Institute Publication 1509.

In one embodiment, the hydrocracking catalyst for producing the lubricating base oil is a promoted self-supported catalyst derived from a catalyst precursor. The catalyst precursor can be a hydroxide or oxide material, prepared from at least a Group VIB metal precursor feed and at least another metal precursor feed. The at least another metal precursor can be used interchangeably with $M^P$, referring to a material that enhances the activity of a catalyst (as compared to a catalyst without the at least another metal, e.g., a catalyst with just a Group VIB metal), with the promoter being present in an amount of at least 0.05 to about 5 molar times of the total number of moles of the metals of Group VIB and at least another metal present, e.g., a Group VIII metal. In one embodiment, the promoter is present in an amount of up to 1000 molar times the total number of moles of the metals.

The self-supported or unsupported catalyst precursor can be converted into a hydroconversion catalyst (becoming catalytically active) upon sulfidation. However, the self-supported catalyst precursor can be used in pretreating the dewaxer feedstock by itself (as a catalyst), or it can be sulfided prior to use, or sulfided in-situ in the presence of sulfiding agents in the reactor. In one embodiment, the self-supported catalyst precursor is used un-sulfided, with or without any addition of sulfiding agents (e.g., $H_2S$) to the reactor system or inherent in the feed, even for the hydroconversion of a feedstock without any sulfur present in the feed as sulfiding agent. In one embodiment, the self-supported catalyst precursor, or the self-supported mixed metal sulfide catalyst that is prepared from the precursor, contains no zeolite or molecular sieve.

In one embodiment, the catalyst precursor is in the form of a hydroxide compound, comprising at least one Group VIII metal and at least two Group VIB metals. In one embodiment, the hydroxide catalyst precursor is represented by the formula:

$$A_v[(M^P)(OH)_x(L)^n{}_y]_z(M^{VIB}O_4),$$

wherein A is one or more monovalent cationic species; MP has an oxidation state (P) of either +2 or +4 depending on the metal(s) being employed; L is one or more oxygen-containing promoters, and L has a neutral or negative charge $n \leq 0$; $M^{VIB}$ is at least a Group VIB metal having an oxidation state of +6; $M^P:M^{VIB}$ has an atomic ratio between 100:1 and 1:100; $v-2+P*z-x*z+n*y*z=0$; and $0<v\leq 2$; $0<x\leq P$; $0<y\leq -P/n$; $0<z$. In one embodiment, the catalyst precursor is charge-neutral, carrying no net positive or negative charge.

In one embodiment, A is selected from the group consisting of an alkali metal cation, an ammonium cation, an organic ammonium cation and a phosphonium cation.

In one embodiment, $M^P$ has an oxidation state of either +2 or +4. $M^P$ is at least one of a Group IIA metal, Group IIB metal, Group IVA metal, Group VIII metal and combinations thereof. In one embodiment, $M^P$ is at least a Group VIII metal with $M^P$ having an oxidation state P of +2. In another embodiment, $M^P$ is selected from Group IIB metals, Group IVA metals and combinations thereof. In one embodiment, $M^P$ is selected from the group of Group IIB and Group VIA metals such as zinc, cadmium, mercury, germanium, tin or lead, and combinations thereof, in their elemental, compound, or ionic form. In another embodiment, $M^P$ is a Group IIA metal compound, selected from the group of magnesium, calcium, strontium and barium compounds. $M^P$ can be in solution or in partly in the solid state, e.g., a water-insoluble compound such as a carbonate, hydroxide, fumarate, phosphate, phosphite, sulfide, molybdate, tungstate, oxide, or mixtures thereof.

In one embodiment, the promoter L has a neutral or negative charge n≤0. Examples of promoters L include but are not limited to carboxylates, carboxylic acids, aldehydes, ketones, the enolate forms of aldehydes, the enolate forms of ketones, and hemiacetals; organic acid addition salts such as formic acid, acetic acid, propionic acid, maleic acid, malic acid, cluconic acid, fumaric acid, succinic acid, tartaric acid, citric acid, oxalic acid, glyoxylic acid, aspartic acid, alkane sulfonic acids such as methanesulfonic acid and ethanesulfonic acid, aryl sulfonic acids such as benzenesulfonic acid and p-toluenesulfonic acid and arylcarboxylic acids; carboxylate containing compounds such as maleate, formate, acetate, propionate, butyrate, pentanoate, hexanoate, dicarboxylate, and combinations thereof.

In one embodiment, $M^{VIB}$ is at least a Group VIB metal having an oxidation state of +6. In another embodiment, $M^{VIB}$ is a mixture of at least two Group VIB metals, e.g., molybdenum and tungsten. $M^{VIB}$ can be in solution or in partly in the solid state. In one embodiment, $M^P$:$M^{VIB}$ has a mole ratio of 10:1 to 1:10.

Mixed metal sulfide catalyst refers to a catalyst containing transition metal sulfides of molybdenum, tungsten, and nickel in one embodiment, and of nickel and molybdenum or nickel and tungsten in a second embodiment and molybdenum and tungsten in yet another embodiment.

In one embodiment, the invention relates to self-supported mixed metal sulfide catalysts having optimized hydrocracking activity, and thus outstanding HDN and HDS performance. In one embodiment, the self-supported mixed metal sulfide catalysts contain at least two metals from Group VIB, e.g., Mo and W, and at least a metal from Group VIII, such as Ni, and multiphase combinations thereof.

It was discovered that a mixed metal sulfide catalyst containing nickel, tungsten, and molybdenum sulfides within a range of optimum metal ratios exhibits a unique hydrocracking activity in the absence of a highly acidic cracking function, including in the absence of a zeolite, molecular sieve or silica-alumina phase, one or more of which are generally associated with hydrocracking catalysts.

In one embodiment, the self-supported mixed metal sulfide catalysts exhibiting an optimum hydrocracking performance are characterized by having an optimized Ni:Mo:W composition with a range of Ni/(Ni+W+Mo) ratios of 0.25≤Ni/(Ni+Mo+W)≤0.8, a range of Mo/(Ni+Mo+W) molar ratios of 0.0≤Mo/(Ni+Mo+W)≤0.25, and a range of W/(Ni+Mo+W) molar ratios of 0.12≤W/(Ni+Mo+W)≤0.75.

In another embodiment, a self-supported catalyst exhibits optimum performance when the relative molar amounts of nickel, molybdenum and tungsten are within a compositional range defined by five points ABCDE in a ternary phase diagram, showing the element contents of nickel, molybdenum and tungsten in terms of their molar fractions. The five points ABCDE are defined by A (Ni=0.80, Mo=0.00, W=0.20), B (Ni=0.25, Mo=0.00, W=0.75), C (Ni=0.25, Mo=0.25, W=0.50), D (Ni=0.63, Mo=0.25, W=0.12), E (Ni=0.80, Mo=0.08, W=0.12).

In one embodiment, the molar ratio of metal components Ni:Mo:W is in a range of: 0.33≤Ni/(Mo+W)≤2.57, a range of Mo/(Ni+W) molar ratios of 0.00≤Mo/(Ni+W)≤0.33, and a range of W/(Ni+Mo) molar ratios of 0.18≤W/(Ni+Mo)≤3.00. In yet another embodiment, the molar ratios of metal components Ni:Mo:W in a region is defined by six points ABCDEF of a ternary phase diagram, and wherein the six points ABCDEF are defined as: A (Ni=0.67, Mo=0.00, W=0.33), B (Ni=0.67, Mo=0.10, W=0.23), C (Ni=0.60, Mo=0.15, W=0.25), D (Ni=0.52, Mo=0.15, W=0.33), E (Ni=0.52, Mo=0.06, W=0.42), F (Ni=0.58, Mo=0.0, W=0.42). In another embodiment, the molar ratio of metal components Ni:Mo:W in a range of: 1.08≤Ni/(Mo+W)≤2.03; 0<=Mo/(Ni+W)≤0.18; and 0.33<=W/(Mo+Ni)≤0.72.

In yet another embodiment, the molar ratios of metal components Ni:Mo:W in a region is defined by four points ABCD of a ternary phase diagram, and wherein the four points ABCD are defined as: A(Ni=0.67, Mo=0.00, W=0.33), B(Ni=0.58, Mo=0.0, W=0.42), C(Ni=0.52, Mo=0.15, W=0.33), D(Ni=0.60, Mo=0.15, W=0.25).

In one embodiment, a bi-metallic nickel tungsten sulfide self-supported catalyst exhibits optimum hydrocracking performance when the relative molar amounts of nickel, and tungsten are in an optimum range within the six points ABCDEF defined by A(Ni=0.67, Mo=0.00, W=0.33), B(Ni=0.58, Mo=0.0, W=0.42), C(Ni=0.52, Mo=0.15, W=0.33), D(Ni=0.60, Mo=0.15, W=0.25), E (Ni=0.25, W=0.75) and F (Ni=0.8, W=0.2) in a ternary phase diagram, for a Ni:W molar ratio ranges from 1:3 to 4:1, on a transition metal basis). In yet another embodiment, the bi-metallic catalyst further comprises a metal promoter selected from Mo, Nb, Ti, and mixtures thereof, wherein the metal promoter is present in an amount of less 1% (mole).

In another embodiment, a bi-metallic molybdenum tungsten sulfide self-supported catalyst exhibits improved hydrocracking performance comparing to molybdenum sulfide alone or tungsten sulfide alone when the relative molar amounts of nickel, and tungsten are in the optimum range within the eight points ABCDEFGH defined by A(Ni=0.67, Mo=0.00, W=0.33), B(Ni=0.58, Mo=0.0, W=0.42), C(Ni=0.52, Mo=0.15, W=0.33), D(Ni=0.60, Mo=0.15, W=0.25), E (Ni=0.25, W=0.75) and F (Ni=0.8, W=0.2), G (Mo=0.001, W=0.999) and H (Mo=0.999, W=0.001) in a ternary phase diagram (with at least 0.1 mol % of Mo and at least 0.1 mol % of W, on a transition metal basis).

In one embodiment of a self-supported mixed metal sulfide catalyst containing molybdenum, tungsten, and nickel in an optimum compositional range is characterized as being multiphased, wherein the structure of the catalyst comprises five phases: a molybdenum sulfide phase, a tungsten sulfide phase, molybdenum tungsten sulfide phase, an active nickel phase, and a nickel sulfide phase. The molybdenum, tungsten and molybdenum tungsten sulfide phases comprise at least a layer, with the layer comprising at least one of: a) molybdenum sulfide and tungsten sulfide; b) tungsten isomorphously substituted into molybdenum sulfide either as individual atoms or as tungsten sulfide domains; c) molybdenum isomorphously substituted into tungsten sulfide either as individual atoms or as molybdenum sulfide domains; and d) mixtures of the aforementioned layers.

Further details regarding the description of the catalyst precursor and the self-supported catalyst formed thereof are described in a number of patents and patent applications, including U.S. Pat. Nos. 6,156,695; 6,162,350; 6,274,530; 6,299,760; 6,566,296; 6,620,313; 6,635,599; 6,652,738; 6,758,963; 6,783,663; 6,860,987; 7,179,366; 7,229,548; 7,232,515; 7,288,182; 7,544,285, 7,615,196; 7,803,735; 7,807,599; 7,816,298; 7,838,696; 7,910,761; 7,931,799; 7,964,524; 7,964,525; 7,964,526; 8,058,203; and U.S. Pat. Application Publication Nos. 2007/0090024, 2009/0107886, 2009/0107883, 2009/0107889 and 2009/0111683, the relevant disclosures are included herein by reference.

Embodiments of the process for making the self-supported catalyst precursor are as described in the references indicated above, and incorporated herein by reference. In one embodiment, the first step is a mixing step wherein at least one Group VIB metal precursor feed and at least one another metal precursor feed are combined together in a precipitation step (also called co-gelation or co-precipitation), wherein a catalyst precursor is formed as a gel. The precipitation (or "co-gelation") is carried out at a temperature and pH under which the Group VIB metal compound and at least another metal compound precipitate (e.g., forming a gel). In one embodiment, the temperature is from 25° C. to 350° C. and the pressure is from 0 to 3000 psig (0 to 20.7 MPa gauge). The pH of the reaction mixture can be changed to increase or decrease the rate of precipitation (co-gelation), depending on the desired characteristics of the catalyst precursor product, e.g., an acidic catalyst precursor. In one embodiment, the mixture is left at its natural pH during the reaction step(s). The pH is maintained in the range from 3-9 in one embodiment; and from 5-8 in a second embodiment.

EXAMPLES

Example 1: Ni—Mo—W-Maleate Catalyst Precursor

A catalyst precursor of the formula $$(NH_4)^+\{[Ni_{2.6}(OH)_{2.08}(C_4H_2O_{42})_{0.06}](Mo_{0.35}W_{0.65}O_4)_2\}$$

was prepared as follows: 52.96 g of ammonium heptamolybdate (NH4)6Mo7O24.4H2O was dissolved in 2.4 L of deionized water at room temperature. The pH of the resulting solution was within the range of 5-6. 73.98 g of ammonium metatungstate powder was then added to the above solution and stirred at room temperature until completely dissolved. 90 ml of concentrated (NH4)OH was added to the solution with constant stirring. The resulting molybdate/tungstate solution was stirred for 10 minutes and the pH monitored. The solution had a pH in the range of 9-10. A second solution was prepared containing 174.65 g of Ni(NO3)2.6H2O dissolved in 150 ml of deionized water and heated to 90° C. The hot nickel solution was then slowly added over 1 hr to the molybdate/tungstate solution. The resulting mixture was heated to 91° C. and stirring continued for 30 minutes. The pH of the solution was in the range of 5-6. A blue-green precipitate formed and the precipitate was collected by filtration. The precipitate was dispersed into a solution of 10.54 g of maleic acid dissolved in 1.8 L of deionized water and heated to 70° C. The resulting slurry was stirred for 30 min. at 70° C., filtered, and the collected precipitate vacuum dried at room temperature overnight. The material was then further dried at 120° C. for 12 hr. The resulting material has a typical XRD pattern with a broad peak at 2.5 Å, denoting an amorphous Ni—OH containing material. The BET Surface area of the resulting material was 101 m2/g, the average pore volume was around 0.12-0.14 cm3/g, and the average pore size was around 5 nm.

Example 2: Base Oil Production Employing Conventional Lubricating Oil Hydrocracking Catalyst A commercial crude oil distillate, having the properties listed in Table I, was converted in a hydrocracking reaction zone over the following layered catalyst system (see Table III): 10 wt. % Catalyst A; 70 wt. % Catalyst B; 20 wt. % Catalyst C.

Reaction conditions included the following:

2100 PSIG total pressure (2000 PSIA $H_2$ at the reactor inlet)

5500 SCFB once through $H_2$ 0.65 LHSV (overall)

The reaction temperature was controlled to a target 1.2 ppm in the 700° F. stripped reactor effluent. Results are tabulated in Table IV.

Example 3: Base Oil Production Employing Catalyst of the Invention

Example 2 was repeated using a layered catalyst system comprising the catalyst of the invention (see Table III): 20 wt. % Catalyst A; 40 wt. % Catalyst B; 40 wt. % Catalyst D.

The results show that the catalyst of the invention is 11° F. more active than the conventional zeolitic catalyst for meeting the target nitrogen level in the product, while maintaining essentially the same total base oil yield. As shown in Table IV, the catalyst of the invention produced 2.4 wt. % more heavy lubricant base oil (900° F.+ fraction).

Example 4: Catalyst Fouling Test

Examples 2 and 3 were repeated using a lubricating oil feedstock that contained high amounts of polycyclics for measuring the fouling resistance of the conventional hydrocracking catalyst system and of the catalyst system of the invention. A lubricating oil feedstock was prepared by blending a hydroprocessed feedstream with the crude oil distillate of Table I in a crude oil distillate to hydroprocessed feedstream ratio of 9:1. Properties of the blend are tabulated in Table II. With this feed, the conventional catalyst of Example 2 was unable to maintain a nitrogen product target of 1.2 ppm due to an excessive fouling rate, and the test was stopped prematurely. The catalyst system of Example 3 showed much higher resistance to deactivation under these severe conditions. The measured fouling rate for the catalyst system of the invention was 7.6° F./1000 (4.2° C.) operating hours, and significantly better than the conventional commercial catalyst system. Reaction conditions and product properties for hydrocracking the blended feed of Table II with a catalyst system of the invention are listed in Table IV. It can be observed that the performance of the catalyst of the invention was not detrimentally affected by the feed blend which included the hydroprocessed feedstock.

TABLE I

| Crude Oil Distillate Feed | |
|---|---|
| Density, 60° F. | 0.94 |
| N, ppm | 1311 |

TABLE I-continued

| Crude Oil Distillate Feed | |
|---|---|
| S, wt % | 2.22 |
| C/H, atomic ratio | 1.68 |
| VI | 63 |
| Vis @ 100° C., cSt. | 14.2 |
| Vis @ 70° C., cSt. | 39.99 |
| Sim Dist, wt. % | ° F. |
| 0.5/5 | 626/748 |
| 10/30 | 793/869 |
| 50 | 917 |
| 70/90 | 962/1024 |
| 95/99 | 1052/1099 |

TABLE II

| Blended lubricating oil feedstock | |
|---|---|
| Density, 60° F. | 0.94 |
| N, ppm | 1250 |
| S, wt % | 1.97 |
| C/H, atomic ratio | 1.69 |
| VI | 70 |
| Vis @ 100° C., cSt. | 14.08 |
| Vis @ 70° C., cSt. | 38.91 |
| Sim Dist, wt. % | ° F. |
| 0.5/5 | 531/680 |
| 10/30 | 765/860 |
| 50 | 914 |
| 70/90 | 964/1034 |
| 95/99 | 1066/1127 |

TABLE III

| Catalysts | |
|---|---|
| Catalyst A | a commercially available high-activity non-zeolitic catalyst for hydrotreating applications from Chevron Lummus Global of San Ramon, Calif. of a pore size in the range of from 80 to 100 angstroms (Å) |
| Catalyst B | a commercially available high-activity non-zeolitic catalyst for hydrotreating applications, also from Chevron Lummus Global, with a smaller pore size in the range of from 70 to 90 Å. |
| Catalyst C | a commercially available high-activity zeolitic catalyst for lube base oil hydrocracking applications. |
| Catalyst D | catalyst prepared using the procedure of Example 1. |

TABLE IV

| | Example 2 | Example 3 | Example 4 |
|---|---|---|---|
| Catalyst System | 10% Cat A<br>70% Cat B<br>20% Cat C | 20% Cat A<br>40% Cat B<br>40% Cat D | 20% Cat A<br>40% Cat B<br>40% Cat D |
| | Whole Liquid Product | | |
| C.A.T., ° F. | 720 | 709 | 729 |
| Conversion, wt. % | 24.5 | 21.8 | 22.5 |
| Total Base oil Yield, wt. % | 73.6 | 73.8 | 70.1 |
| Nitrogen, ppm | 1.2 | 1.2 | 1.2 |
| Sulfur, ppm | 15 | 15 | 9 |
| Viscosity Index | 108 | 105 | N/A |
| Viscosity at 100° C. | 8.766 | 9.016 | N/A |
| | 900° F. + fraction | | |
| Yield, wt. % | 38.6 | 41.0 | 44.2 |
| Viscosity @ 100° C. | 12.13 | 12.01 | 12.31 |
| VI | 111 | 108 | 109 |
| Nitrogen, ppm | 1.0 | 1.2 | 1.2 |
| Sulfur, ppm | 19 | 19 | 11 |

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained. It is noted that, as used in this specification and the appended claims, the singular forms "a," "an," and "the," include plural references unless expressly and unequivocally limited to one referent. As used herein, the term "include" and its grammatical variants are intended to be non-limiting, such that recitation of items in a list is not to the exclusion of other like items that can be substituted or added to the listed items. As used herein, the term "comprising" means including elements or steps that are identified following that term, but any such elements or steps are not exhaustive, and an embodiment can include other elements or steps.

Unless otherwise specified, the recitation of a genus of elements, materials or other components, from which an individual component or mixture of components can be selected, is intended to include all possible sub-generic combinations of the listed components and mixtures thereof.

The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims. To an extent not inconsistent herewith, all citations referred to herein are hereby incorporated by reference.

What is claimed is:

1. A process for hydrocracking a lubricating oil feedstock comprising:

blending a straight run crude oil distillate feedstock and a hydroprocessed feedstream to form a lubricating oil feedstock having a nitrogen content of greater than 300 ppm and a sulfur content of greater than 0.1 wt. %; wherein the crude oil distillate has a viscosity at 100° C. in a range from 3 cSt to 30 cSt and the hydroprocessed feedstream has a viscosity at 100° C. in a range from 2 cSt to 30 cSt;

hydrocracking the lubricating oil feedstock with a hydrogen-containing treat gas over a self-supported mixed metal sulfide catalyst under hydrocracking conditions to form a hydrocrackate, wherein at least 10 wt. % of the feedstock is converted to products which boil below the initial boiling point of the feedstock;

separating the hydrocrackate by atmospheric distillation or vacuum distillation into at least a gaseous product that contains ammonia, and a liquid fraction that boils above the initial boiling point of the feedstock and has a nitrogen content of less than 50 ppm;

dewaxing the liquid fraction in the presence of a hydrogen-containing treat gas stream over a shape selective intermediate pore size molecular sieve catalyst at hydroisomerization conditions, to produce a dewaxed effluent having a pour point of less than −5° C.; and providing the dewaxed effluent to a hydrofinishing reaction zone for hydrogenating the dewaxed effluent over a hydrofinishing catalyst;

to form a heavy lubricating base oil having a viscosity index of greater than 95 and a viscosity at 100° C. of 10 cSt or greater;

wherein the self-supported mixed metal sulfide catalyst comprises at least one Group VIB metal and at least one Group VIII metal and is prepared by drying at a temperature of 200° C. or less, then sulfidizing a self-supported charge-neutral hydroxide catalyst precursor composition of the formula:

$$A_v[(M^P)(OH)_x(L)^n{}_y]_z(M^{VIB}O_4)$$

wherein A is at least one of an alkali metal cation, an ammonium, an organic ammonium and a phosphonium cation, $M^P$ is at least one of a Group VIII metal, Group IIB metal, Group IIA metal, Group IVA metal or combinations thereof, P is an oxidation state with $M^P$ having an oxidation state of +2 or +4 depending on the selection of $M^P$, $M^{VIB}$ is at least a Group VIB metal having an oxidation state of +6, L is at least one oxygen-containing ligands, and L has a neutral or negative charge n<=0; $M^P$:$M^{VIB}$ has an atomic ratio between 100:1 and 1:100; $v-2+P*z-x*z+n*y*z=0$; and $0<y\leq -P/n$; $0<x\leq P$; $0<v\leq 2$; $0<z$;

wherein the hydroxide catalyst precursor has an X-ray diffraction pattern which is amorphous with broad peaks or the hydroxide catalyst precursor has an X-ray diffraction pattern with at least a crystalline peak at Bragg angle between 52.7° to 53.2° theta.

2. The process of claim 1, wherein the self-supported mixed metal sulfide catalyst contains no zeolite or molecular sieve.

3. The process of claim 1, wherein the hydroprocessed feedstream has a nitrogen content of greater than 300 ppm and a sulfur content of greater than 0.1 wt. %, optionally wherein the hydroprocessed feedstream is derived from a process of hydrocracking at least one of a crude oil, a gas oil, a vacuum gas oil, a residual fraction, a solvent-deasphalted petroleum residuum, an FCC tower bottoms, a petroleum distillate, and combinations thereof.

4. The process of claim 1, wherein the lubricating oil feedstock is hydrocracked in a layered catalyst system or in a single reaction stage.

5. The process of claim 1, wherein the lubricating oil feedstock comprises up 20 wt. % of the hydroprocessed feedstream.

6. The process of claim 1, wherein the lubricating oil feedstock further comprises a crude oil distillate boiling in a temperature range of 650° F. to 1300° F. and having a nitrogen content of greater than 500 ppm, optionally wherein the weight ratio of the crude oil distillate to the hydroprocessed feedstream is within the range from 99:1 to 80:20.

7. The process of claim 1, comprising a layered catalyst system.

8. The process of claim 1, wherein the lubricating oil feedstock boils in a temperature range from 500° F. to 1300° F., and has a density in a range from 0.85 to 1.0 g/cm$^3$, a nitrogen content in a range from 500 ppm to 3000 ppm, a sulfur content in a range from 0.05% to 4%, and a viscosity at 100° C. in a range from 3 cSt to 30 cSt, or wherein in the range of between 10 wt. % and 50 wt. % of the lubricating oil feedstock is converted to hydrocarbon products which boil below the initial boiling point of the feedstock.

9. The process of claim 1, wherein the lubricating oil feedstock is hydrocracked in a layered catalyst system comprising a layer of hydrotreating catalyst and a layer of hydrocracking catalyst in a weight ratio within the range 1:10 and 10:1, the hydrocracking catalyst comprising the self-supported mixed metal sulfide catalyst, optionally wherein the lubricating oil feedstock is provided to the hydrotreating catalyst to produce a hydrotreated effluent, the entire volume of which is provided to the hydrocracking catalyst.

10. The process of claim 9, wherein the hydrotreating catalyst comprises in the range from 0.5% to about 25% by weight of a Group VIII metal component and from about 0.5% to about 25% by weight of Group VIB metal component.

11. The process of claim 1, wherein the hydrocracking conditions include a temperature of from 450° F. to 900° F. (232° C. to 482° C.); a pressure of from 500 psig to 5000 psig (3.5 MPa to 34.5 MPa gauge); a liquid reactant feed rate, in terms of liquid hourly space velocity (LHSV) of from 0.1 hr$^{-1}$ to 15 hr$^{-1}$ (v/v); and a hydrogen feed rate, in terms of $H_2$/hydrocarbon ratio, of from 500 SCF/bbl to 5000 SCF/bbl (89 to 890 m$^3$ $H_2$/m$^3$ feedstock) of liquid lubricating oil feedstock, or wherein the hydrofinishing conditions include a temperature of from 300° F. to 600° F. (149° C. to 316° C.); a pressure of from 400 psig to 3000 psig (2.76 MPa to 20.68 MPa gauge); a LHSV of from 0.1 hr$^1$ to 20 hr$^1$, and a hydrogen recycle rate of from 400 SCF/bbl to 1500 SCF/bbl (71 to 267 m$^3$ $H^2$/m$^3$ feed).

12. The process of claim 1, wherein the liquid fraction boils within the temperature range from 650° F. to 1300° F., and has a viscosity at 100° C. of greater than 10 cSt.

13. The process of claim 1, further comprising dewaxing the liquid fraction over a shape selective catalyst comprising a dewaxing component selected from SAPO-11, SM-3, SM-7, SSZ-32, and ZSM-23 or combinations thereof, and a noble metal component selected from platinum, palladium, or combinations thereof, at hydroisomerization conditions, which include a temperature of from 500° F. to 775° F. (260° C. to 413° C.); a pressure of from 15 psig to 3000 psig (0.10 MPa to 20.68 MPa gauge); a LHSV of from 0.25 hr$^{-1}$ to 20 hr$^{-1}$; and a hydrogen to feed ratio of from 2000 SCF/bbl to 30,000 SCF/bbl (356 to 5340 m$^3$ $H_2$/m$^3$ feed).

14. The process of claim 1, wherein the heavy lubricating base oil boils within a temperature range from 750° to 1300° F. (399° C. to 704° C.) and has a nitrogen content of less than 20 ppm, or wherein the heavy lubricating base oil boils within a temperature range from 800° F. to 1300° F. and has a viscosity index of greater than 95.

15. The process of claim 1, wherein the self-supported mixed metal sulfide catalyst comprises molybdenum (Mo) sulfide, tungsten (W) sulfide, nickel (Ni) sulfide, or a combination thereof, wherein the catalyst has a BET surface area of at least 20 m$^2$/g and a pore volume of at least 0.05 cm$^3$/g.

16. The process of claim 1, wherein the catalyst is characterized as having molar ratios of metal components Ni:Mo:W in a region defined by five points ABCDE of a ternary phase diagram, and wherein the five points ABCDE are defined as: A (Ni=0.72, Mo=0.00, W=0.28), B (Ni=0.55, Mo=0.00, W=0.45), C (Ni=0.48, Mo=0.14, W=0.38), D (Ni=0.48, Mo=0.20, W=0.33), E (Ni=0.62, Mo=0.14, W=0.24).

17. The process of claim 1, wherein the catalyst is characterized as having a molar ratio of metal components Ni:Mo:W in a range of $0.33\leq Ni/(Mo+W)\leq 2.57$, a range of Mo/(Ni+W) molar ratios of $0.00\leq Mo/(Ni+W)\leq 0.33$, and a range of W/(Ni+Mo) molar ratios of $0.18\leq W/(Ni+Mo)\leq 3.00$.

18. The process of claim 1, wherein $M^P$ is nickel (Ni) and $M^{VIB}$ is selected from molybdenum (Mo), tungsten (W), and combinations thereof, and wherein Ni:(Mo+W) has a molar ratio of 10:1 to 1:10.

19. The process of claim 1, wherein $M^P$ is selected from nickel, cobalt, iron, zinc, tin, and combinations thereof.

20. The process of claim 1, wherein $M^{VIB}$ is selected from molybdenum, tungsten, chromium, and combinations thereof and $M^{P}$ is selected from nickel, cobalt, iron, zinc, tin, and combinations thereof.

* * * * *